US009181069B2

(12) United States Patent
I-Te

(10) Patent No.: US 9,181,069 B2
(45) Date of Patent: Nov. 10, 2015

(54) FAIRLEAD FOR CRANE

(71) Applicant: Pan I-Te, Taichung (TW)

(72) Inventor: Pan I-Te, Taichung (TW)

( * ) Notice: Subject to any disclaimer, the term of this patent is extended or adjusted under 35 U.S.C. 154(b) by 21 days.

(21) Appl. No.: 14/246,039

(22) Filed: Apr. 5, 2014

(65) Prior Publication Data

US 2015/0197414 A1 Jul. 16, 2015

(30) Foreign Application Priority Data

Jan. 10, 2014 (TW) ..... 103200568 U

(51) Int. Cl.
*B66D 3/00* (2006.01)
*B66D 1/38* (2006.01)

(52) U.S. Cl.
CPC ..... *B66D 1/38* (2013.01)

(58) Field of Classification Search
CPC ..... B66D 1/36; B66D 1/38; B66D 2700/0191
USPC ..... 254/383, 333
See application file for complete search history.

(56) References Cited

U.S. PATENT DOCUMENTS 2,417,706 A * 3/1947 Scarborough ..... 254/389
3,353,793 A * 11/1967 Nelson ..... 254/333
3,836,123 A * 9/1974 Bausenbach et al. ..... 242/157.1
3,843,094 A * 10/1974 Watts ..... 254/333
4,721,285 A * 1/1988 McMichael ..... 254/333
5,186,283 A * 2/1993 Salmon ..... 187/254
6,247,680 B1 * 6/2001 Cohen ..... 254/333
7,448,597 B2 * 11/2008 Jacobson et al. ..... 254/274
7,475,867 B1 * 1/2009 Romo ..... 254/383
7,607,644 B1 * 10/2009 Gibb et al. ..... 254/383
7,654,213 B1 * 2/2010 Marolda ..... 114/244
7,850,146 B2 * 12/2010 Kempf ..... 254/333
8,714,527 B2 * 5/2014 Chen et al. ..... 254/383
8,720,811 B2 * 5/2014 Zink ..... 242/397.2
2002/0000347 A1 * 1/2002 Baranda et al. ..... 187/254
2010/0207086 A1 * 8/2010 Asensio Bazterra et al. . 254/333
2010/0314594 A1 * 12/2010 Seow ..... 254/333

* cited by examiner

*Primary Examiner* — Emmanuel M Marcelo

(57) ABSTRACT

A fairlead for a crane contains: a plurality of blocks connected together, a connecting unit for connecting the plurality of blocks, a pair of resilient elements fixed on a peripheral side of a slot of a rolling cylinder, such that a steel cable is rolled on the slot, wherein two first segments of the steel cable fall downwardly to connect with a hook so that the hook hooks an object. Each block includes a pressing body, a first bottom formed on the pressing body and having a plurality of arcuate recesses for corresponding to a circular diameter of the steel cable, and the first bottom also has plural guiding ribs for corresponding to the slot of the rolling cylinder.

2 Claims, 10 Drawing Sheets

FAIRLEAD FOR CRANE

FIELD OF THE INVENTION

The present invention relates to a fairlead for a crane which is replaced easily and is manufactured at low cost.

BACKGROUND OF THE INVENTION

A conventional fairlead for a crane is employed to guide a steel cable to be rolled on a rolling cylinder of the crane. However, when any related part of the fairlead is broken, the fairlead has to be replaced, thus causing high replacement cost.

The present invention has arisen to mitigate and/or obviate the afore-described disadvantages.

SUMMARY OF THE INVENTION

The primary object of the present invention is to provide a fairlead for a crane which is replaced easily and is manufactured at low cost.

To obtain the above objective, a fairlead for a crane provided by the present invention contains: a plurality of blocks connected together, a connecting unit for connecting the plurality of blocks, a pair of resilient elements fixed on a peripheral side of a slot of a rolling cylinder, such that a steel cable is rolled on the slot, wherein two first segments of the steel cable fall downwardly to connect with a hook so that the hook hooks an object.

Each block includes a pressing body, a first bottom formed on the pressing body and having a plurality of arcuate recesses for corresponding to a circular diameter of the steel cable, and the first bottom also has plural guiding ribs for corresponding to the slot of the rolling cylinder.

The pressing body includes a first end, a second end, a retaining protrusion and a first cutout which are defined between the first end and the second end, the retaining protrusion has an extending top arranged on a top surface thereof, a shape of the first cutout corresponds to a cross section of the retaining protrusion; the pressing body also includes a limiting notch for retaining with the extending top, and the extending top of the pressing body has two orifices defined thereon.

The connecting unit includes a press projection extending downwardly therefrom and an affixing wing extending outwardly from a top thereof, the press projection has a second bottom and plural arcuate dents for corresponding to the circular diameter of the steel cable; the affixing wing has two holes, two second cutouts, and three third cutouts for inserting at least one first screws and at least one second screw so that the at least one first screw and the at least one second screw with each block.

Each resilient element includes a front segment screwing with the two orifices by ways of the at least one first screws and includes a rear segment screwing with the two holes by using the at least one first screws.

DETAILED DESCRIPTION OF THE PREFERRED EMBODIMENTS

Figure 1:
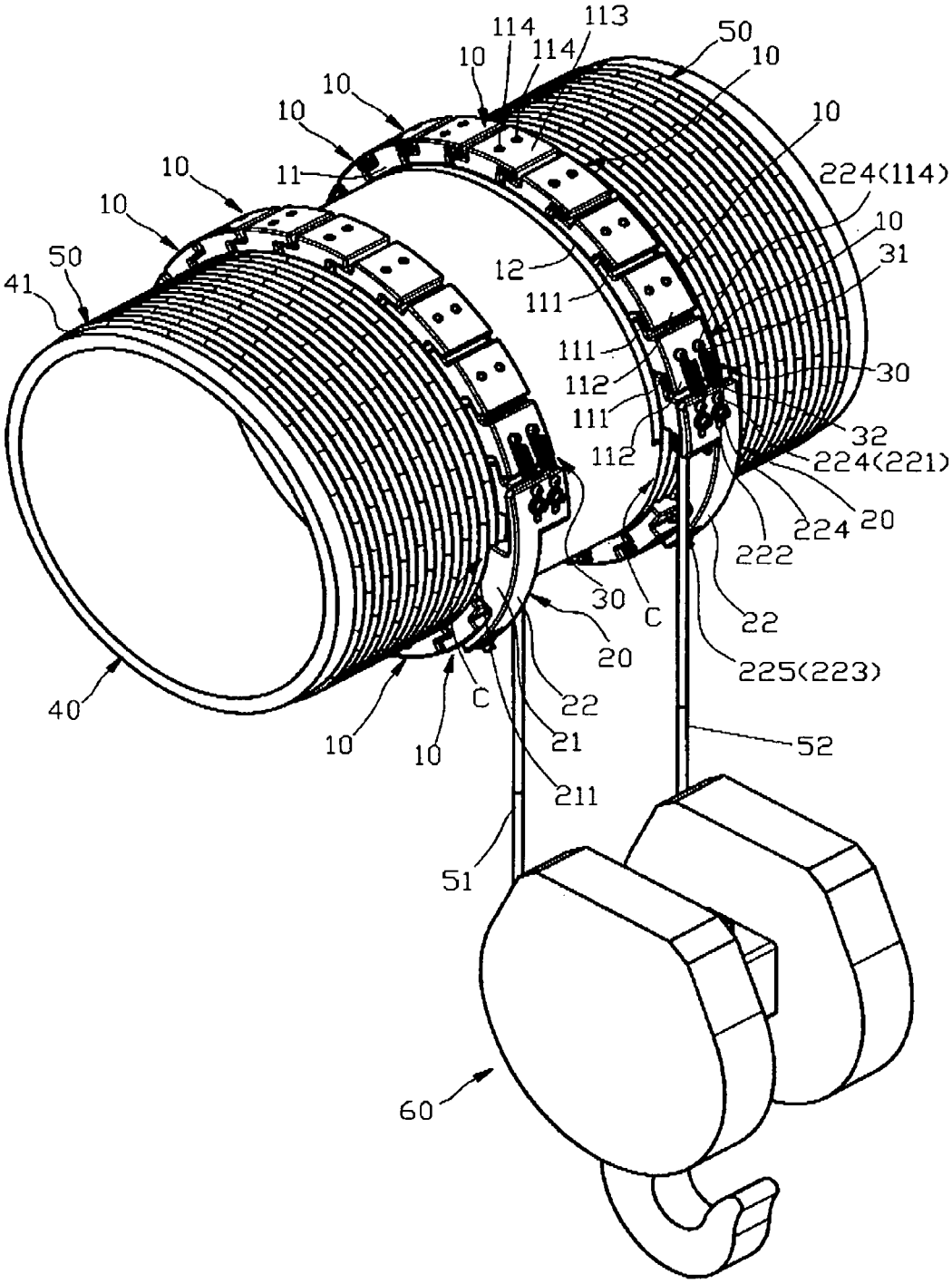
FIG. 1 is a perspective view showing the assembly of a fairlead for a crane according to a preferred embodiment of the present invention.
Figure 2:
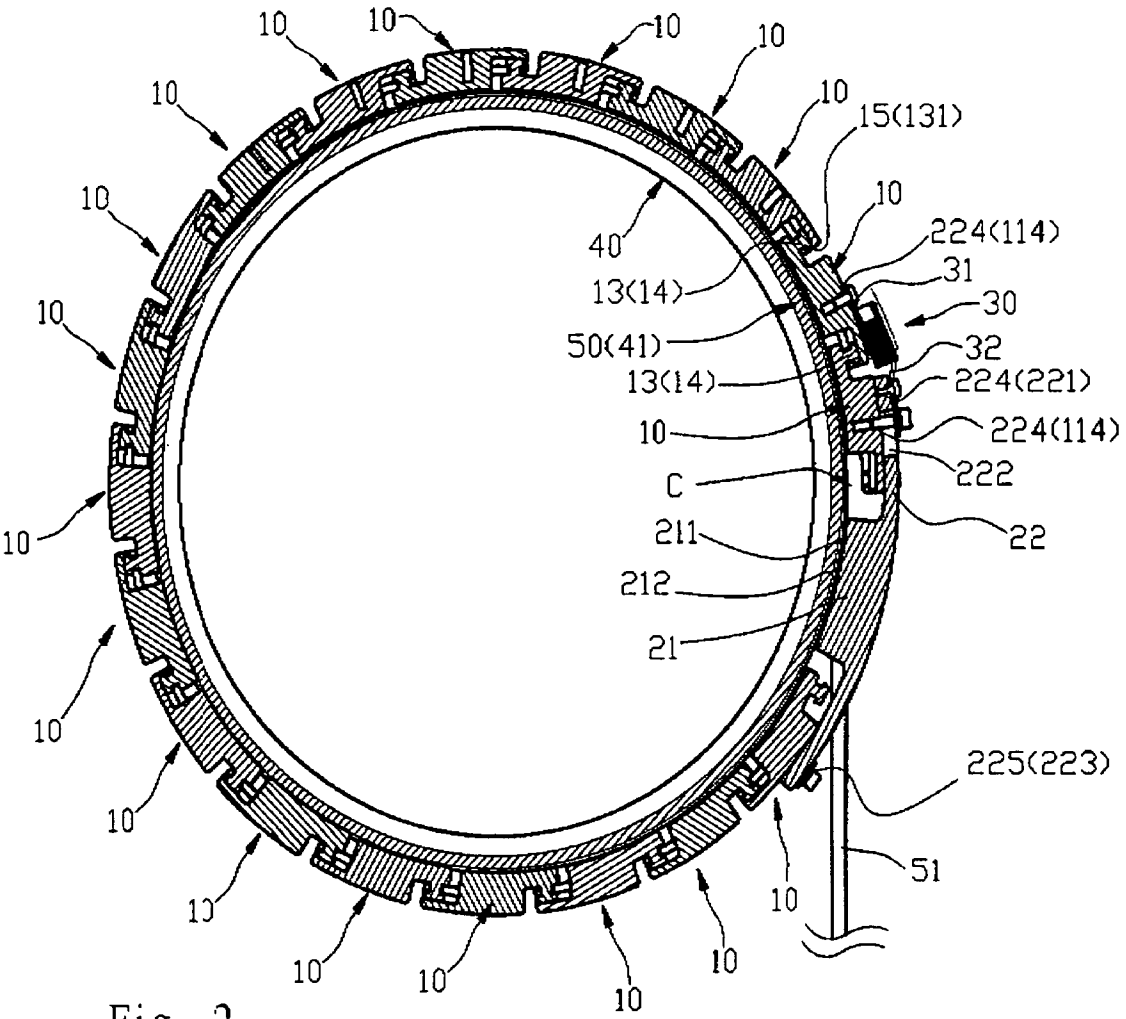
FIG. 2 is a cross sectional view showing the assembly of the fairlead for the crane according to the preferred embodiment of the present invention.
Figure 10:
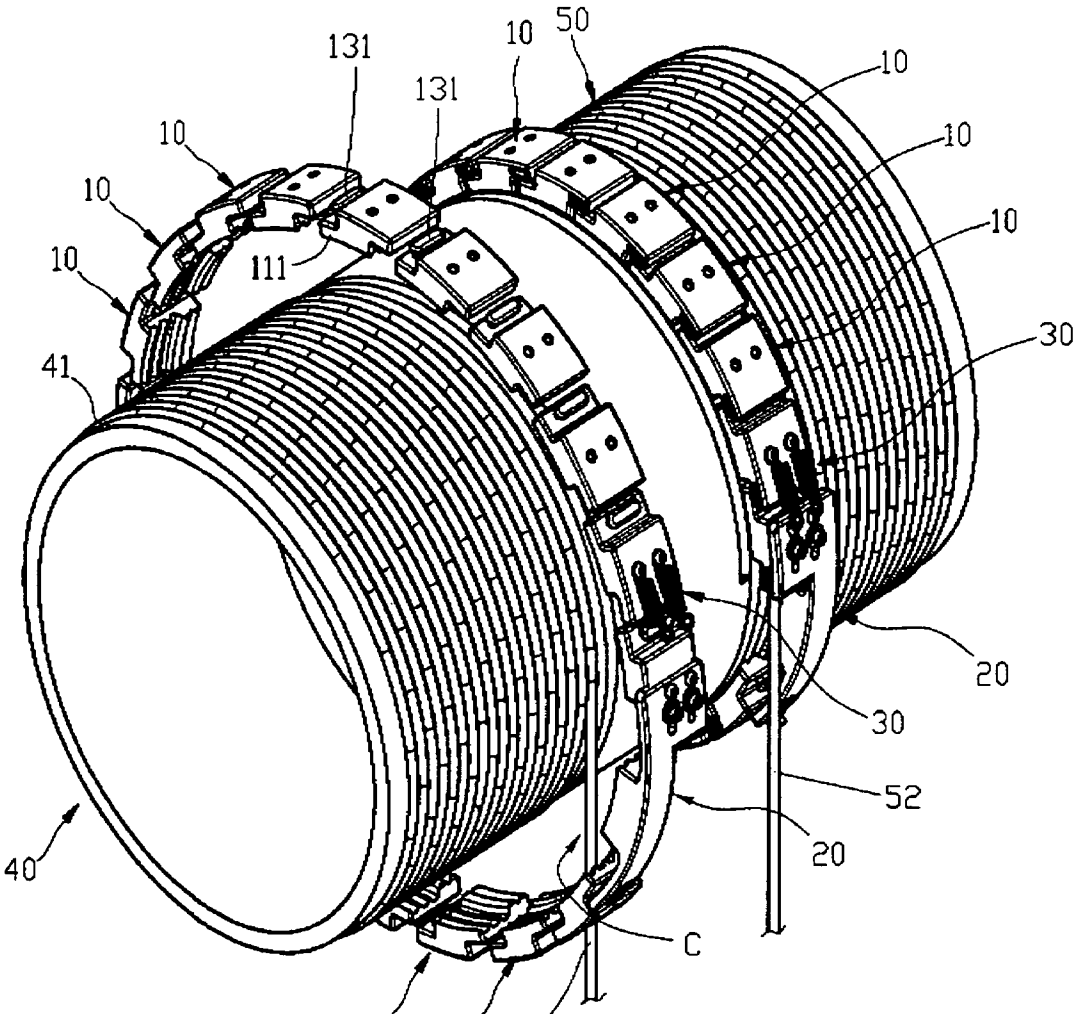
FIG. 10 is a perspective view showing the operation of the fairlead for the crane according to the preferred embodiment of the present invention.

With reference to FIGS. 1, 2 and 10, a fairlead for a crane according to a preferred embodiment of the present invention comprises: a plurality of blocks 10 connected together, a connecting unit 20 for connecting the plurality of blocks 10, a pair of resilient elements 30 fixed on a peripheral side of a slot 41 of a rolling cylinder 40, such that a steel cable 50 is rolled on the slot 41, wherein two first segments 51, 52 of the steel cable 50 fall downwardly to connect with a hook 60 so that the hook 60 hooks an object.

Figure 4:
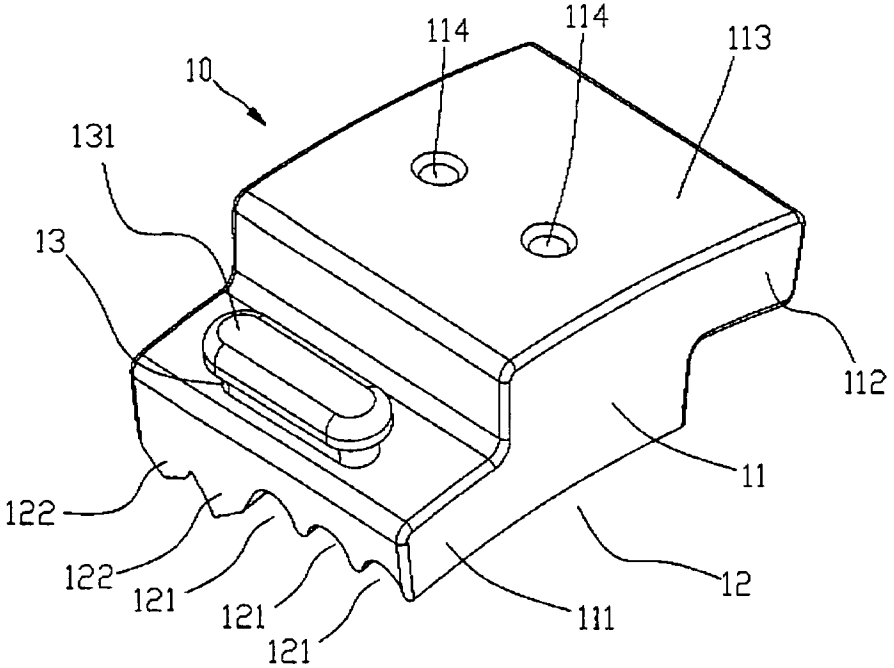
FIG. 4 is a perspective view showing the assembly of a block of the fairlead for the crane according to the preferred embodiment of the present invention.
Figure 5:
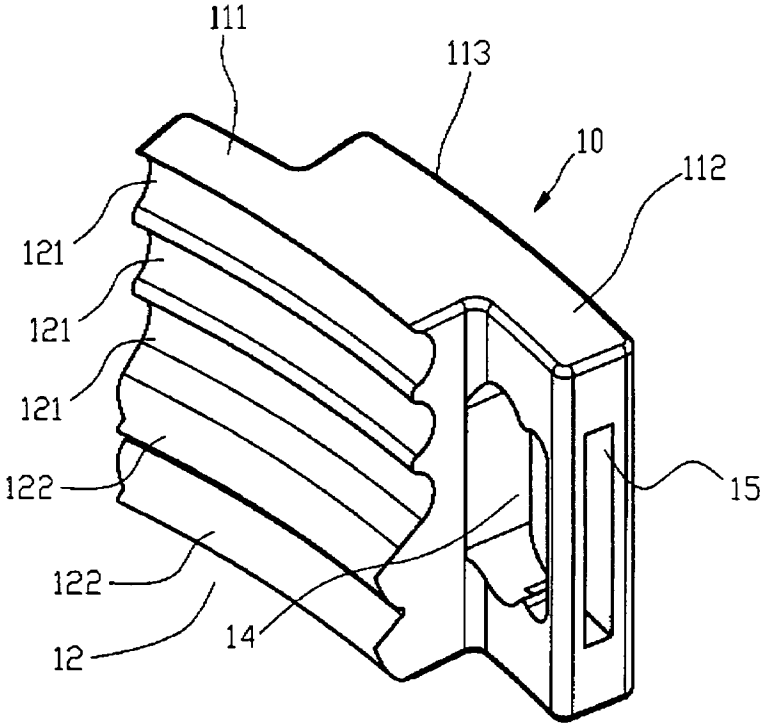
FIG. 5 is another perspective view showing the assembly of the block of the fairlead for the crane according to the preferred embodiment of the present invention.
Figure 8:
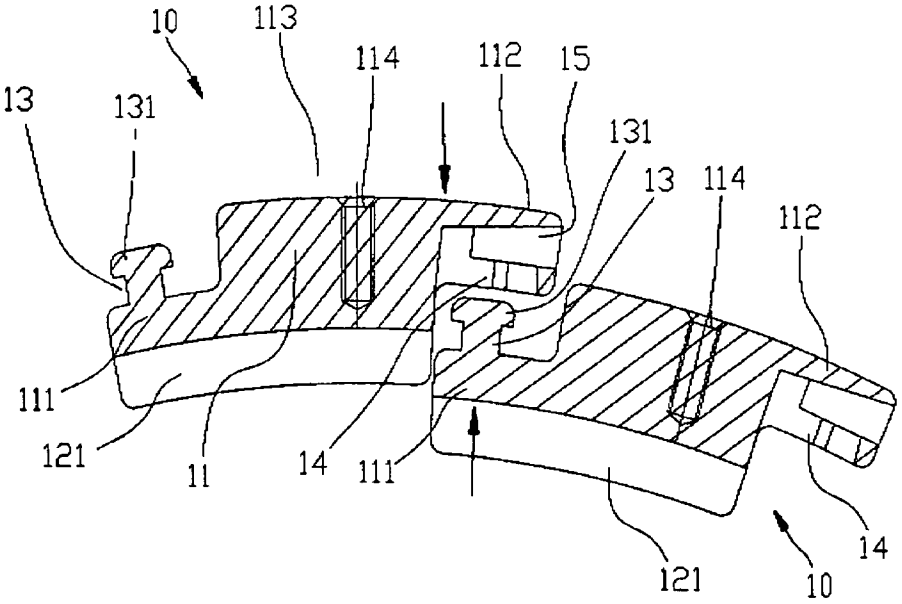
FIG. 8 is a cross sectional view showing the operation of the fairlead for the crane according to the preferred embodiment of the present invention.
Figure 9:
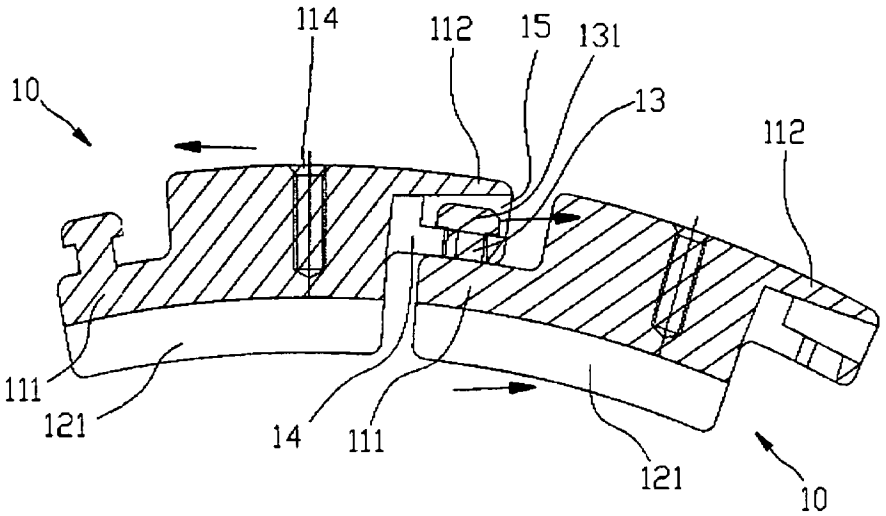
FIG. 9 is another cross sectional view showing the operation of the fairlead for the crane according to the preferred embodiment of the present invention.

As shown in FIGS. 2, 4 and 5, each block 10 includes a pressing body 11, a first bottom 12 formed on the pressing body 11 and having a plurality of arcuate recesses 121 for corresponding to a circular diameter of the steel cable 50, and the first bottom 12 also having plural guiding ribs 122 for corresponding to the slot 41 of the rolling cylinder 40. The pressing body 11 includes a first end 111, a second end 112, a retaining protrusion 13 and a first cutout 14 which are defined between the first end 111 and the second end 112, the retaining protrusion 13 has an extending top 131 arranged on a top surface thereof, a shape of the first cutout 14 corresponds to a cross section of the retaining protrusion 13. The pressing body 11 also includes a limiting notch 15 for retaining with the extending top 131 (as illustrated in FIGS. 8 and 9), and a top 113 of the pressing body 11 has two orifices 114 defined thereon.

Figure 6:
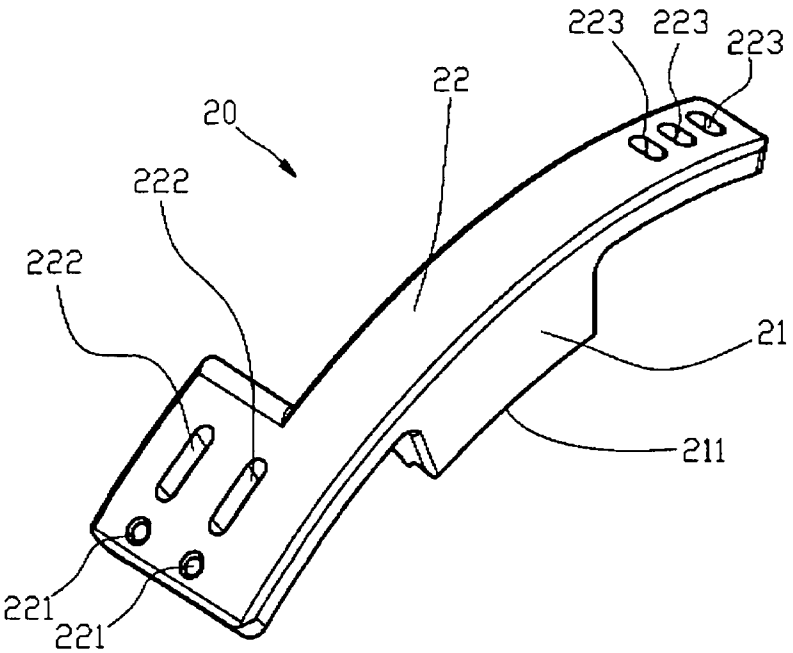
FIG. 6 is a perspective view showing the assembly of a connecting unit of the fairlead for the crane according to the preferred embodiment of the present invention.
Figure 7:
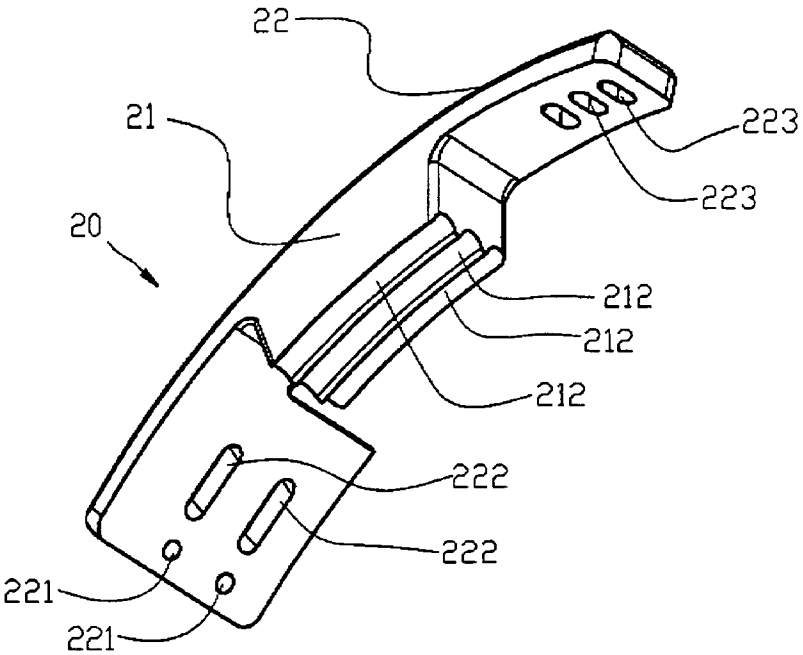
FIG. 7 is another perspective view showing the assembly of the connecting unit of the fairlead for the crane according to the preferred embodiment of the present invention.

Referring further to FIGS. 6 and 7, the connecting unit 20 includes a press projection 21 extending downwardly therefrom and an affixing wing 22 extending outwardly from a top thereof, the press projection 21 has a second bottom 211 and plural arcuate dents 212 for corresponding to the circular diameter of the steel cable 50; the affixing wing 22 has two holes 221, two second cutouts 222, and three third cutouts 223 for inserting at least one first screws 224 and at least one second screw 225 so that the at least one first screw 224 and the at least one second 225 screw with each block 10.

With reference to FIGS. 1, 2 and 10, each resilient element 30 includes a front segment 31 screwing with the two orifices 114 by ways of the at least one first screws 224 and includes a rear segment 32 screwing with the two holes 221 by using the at least one first screws 224.

As shown in FIGS. 4, 5, 8 and 9, a plurality of pressing bodies 11 are coupled together, and the retaining protrusion 13 retains with the first cutout 14. In addition, the extending top 131 of the retaining protrusion 13 retains with the limiting notch 15 so as to form a gap C surrounding around the rolling cylinder 40 as illustrated in FIGS. 2 and 10.

The press projection 21 is placed into the gap C, and the affixing wing 22 connects with the pressing body 11, and the at least one first screw 224 and the at least one second screw 225 insert through the two second cutouts 222, the three third cutouts 223, and the two orifices 114 so as to form an outer circumference of the rolling cylinder 40.

With reference to FIGS. 1 and 2, the front segment 31 screws with the two orifices 114 by means of the at least one first screw 224, the rear segment 32 screws with the two holes 221 by using the at least one first screws 224, thus pulling the connecting unit 20 tightly.

Figure 3:
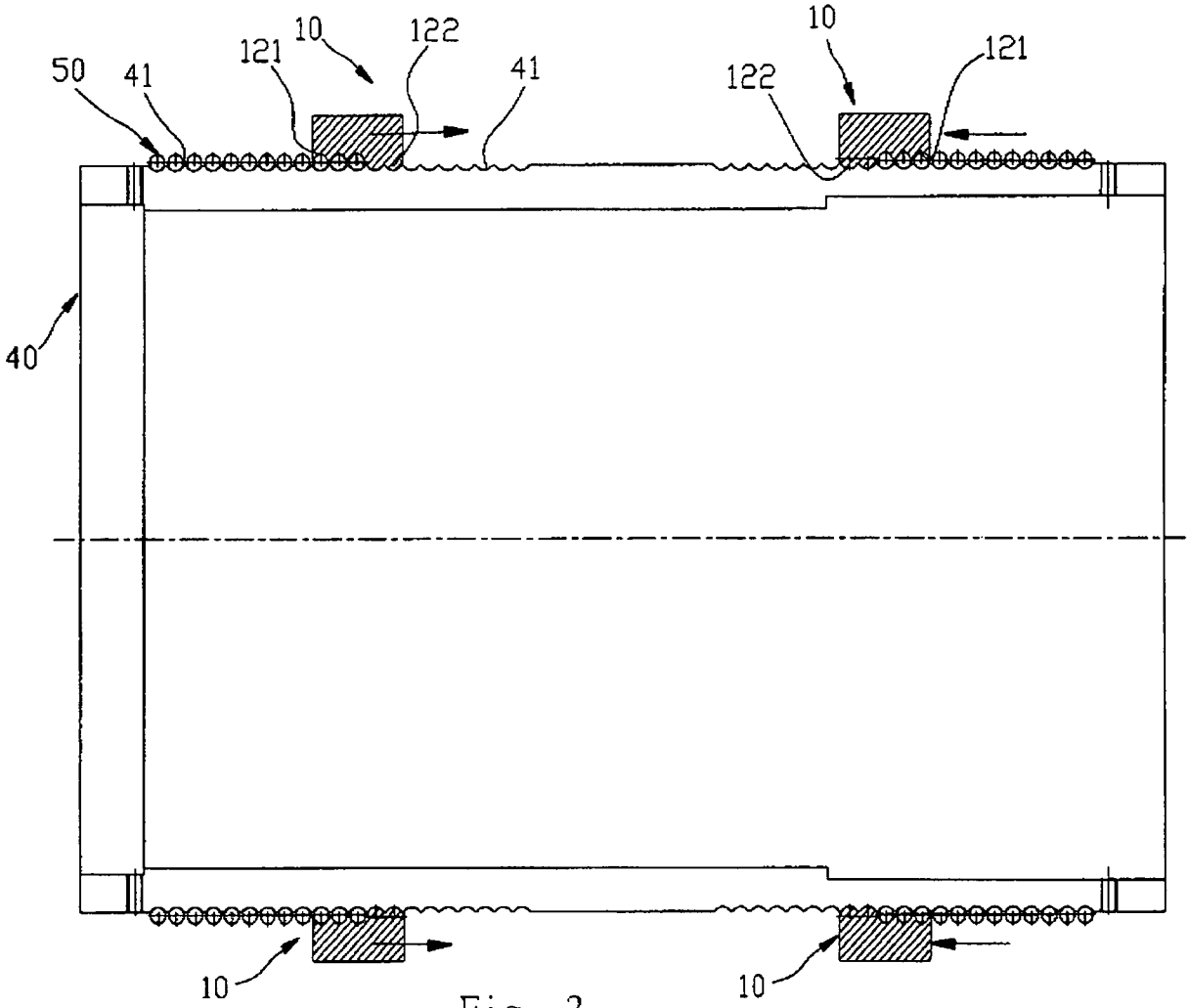
FIG. 3 is another cross sectional view showing the assembly of the fairlead for the crane according to the preferred embodiment of the present invention.

Referring to FIGS. 1 to 3, the plurality of blocks 10 are connected together and fixed around the rolling cylinder 40 by using the connecting unit 20 and the pair of resilient elements 30, wherein the plurality of arcuate recesses 121 retain with the steel cable 50, and the plural guiding ribs 122 retain in the slot 41 of the rolling cylinder 40, hence when the hook 60 moves upwardly, the steel cable 50 rolls around the rolling cylinder 40, and the plurality of pressing bodies 11 move to a middle side of the rolling cylinder 40 so that the steel cable 50 contacts with the rolling cylinder 40 securely.

As desiring to replace the fairlead, as shown in FIG. 10, the pair of resilient elements 30 remove from the at least one first screws 224 so as to check the plurality of blocks 10. If the plurality of blocks 10 are broken, the plurality of pressing bodies 11 are moved inwardly so that the extending top 131 of the retaining protrusion 13 is pushed out of the limiting notch 15, thereafter the retaining protrusion 13 is removed from the first cutout 14 so as to replace the plurality of blocks 10.

Thereby, the fairlead of the present invention is replaced easily and is manufactured at low cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fairlead for a crane comprising:

a plurality of blocks connected together, a connecting unit for connecting the plurality of blocks, a pair of resilient elements fixed on a peripheral side of a slot of a rolling cylinder, such that a steel cable is rolled on the slot, wherein two first segments of the steel cable fall downwardly to connect with a hook so that the hook hooks an object;

wherein each block includes a pressing body, a first bottom formed on the pressing body and having a plurality of arcuate recesses for corresponding to a circular diameter of the steel cable, and the first bottom also has plural guiding ribs for corresponding to the slot of the rolling cylinder;

wherein the pressing body includes a first end, a second end, a retaining protrusion and a first cutout which are defined between the first end and the second end, the retaining protrusion has an extending top arranged on a top surface thereof, a shape of the first cutout corresponds to a cross section of the retaining protrusion; the pressing body also includes a limiting notch for retaining with the extending top, and a top of the pressing body has two orifices defined thereon wherein the connecting unit includes a press projection extending downwardly therefrom and an affixing wing extending outwardly from a top thereof, the press projection has a second bottom and plural arcuate dents for corresponding to the circular diameter of the steel cable; the affixing wing has two holes, two second cutouts, and three third cutouts for inserting at least one first screws and at least one second screw so that the at least one first screw and the at least one second screw with each block.

2. The fairlead for the crane as claimed in claim 1, wherein each said resilient element includes a front segment screwing with the two orifices by ways of the at least one first screws and includes a rear segment screwing with the two holes by using the at least one first screw.

* * * * *